US010661584B2

(12) United States Patent
Hirashima

(10) Patent No.: US 10,661,584 B2
(45) Date of Patent: May 26, 2020

(54) CONVEYANCE DEVICE AND PRINTER

(71) Applicant: SEIKO EPSON CORPORATION, Tokyo (JP)

(72) Inventor: Taku Hirashima, Shenzhen (CN)

(73) Assignee: SEIKO EPSON CORPORATION, Tokyo (JP)

( * ) Notice: Subject to any disclaimer, the term of this patent is extended or adjusted under 35 U.S.C. 154(b) by 84 days.

(21) Appl. No.: 15/875,666

(22) Filed: Jan. 19, 2018

(65) Prior Publication Data

US 2018/0207964 A1 Jul. 26, 2018

(30) Foreign Application Priority Data

Jan. 20, 2017 (JP) ..... 2017-008206
Jan. 20, 2017 (JP) ..... 2017-008207

(51) Int. Cl.

| | |
|---|---|
| ***B41J 15/04*** | (2006.01) |
| ***B41J 11/00*** | (2006.01) |
| ***B41J 11/02*** | (2006.01) |
| ***B41J 11/06*** | (2006.01) |
| ***B41J 13/03*** | (2006.01) |
| ***B41J 3/407*** | (2006.01) |

(52) U.S. Cl.

CPC ..... *B41J 15/046* (2013.01); *B41J 11/007* (2013.01); *B41J 11/0085* (2013.01); *B41J 11/02* (2013.01); *B41J 11/06* (2013.01); *B41J 3/4075* (2013.01); *B41J 13/03* (2013.01)

(58) Field of Classification Search

CPC ..... B41J 15/046; B41J 11/06; B41J 11/007; B41J 11/02; B41J 11/085; B41J 13/03; B41J 3/4075

USPC ..... 34/109

See application file for complete search history.

(56) References Cited

U.S. PATENT DOCUMENTS 1,878,236 A * 9/1932 Griffin ..... D21F 5/00 123/65 VS
3,077,037 A * 2/1963 Fleissner ..... D21F 5/02 34/115
3,359,648 A * 12/1967 Overly ..... F26B 25/004 198/689.1

(Continued)

FOREIGN PATENT DOCUMENTS

JP 2008-183825 A 8/2008
JP 2012-051331 A 3/2012

(Continued)

*Primary Examiner* — Stephen M Gravini
(74) *Attorney, Agent, or Firm* — Foley & Lardner LLP

(57) ABSTRACT

A simple configuration enables easily changing the open or closed state of multiple suction holes while assuring suction. A shutter drum rotates centered on an axis of rotation extending on a transverse axis, and a suction fan that produces negative pressure inside the shutter drum. When one suction hole on the transverse axis is a first suction hole, and another suction hole adjacent on the transverse axis to the first suction hole is a second suction hole, a first communication path including a suction chamber and through-hole communicates with the first suction hole, and a second communication path including a suction chamber and through-hole communicates with the second suction hole. The shutter drum functions as a shutter that, by rotating, selectively changes the open or closed state of the first and second communication paths.

19 Claims, 11 Drawing Sheets

(56) References Cited

U.S. PATENT DOCUMENTS 3,727,325 A * 4/1973 Fleissner ..... D06B 19/0041 26/90
5,669,155 A * 9/1997 Hughes ..... F26B 13/16 34/115
5,746,010 A * 5/1998 Marschke ..... B31F 1/2881 34/631
5,987,774 A * 11/1999 Moskowitz ..... D21G 9/0063 34/117
6,199,296 B1 * 3/2001 Jewitt ..... D21F 5/182 34/115
6,672,720 B2 * 1/2004 Smith ..... B41J 11/007 271/197
7,137,750 B2 * 11/2006 Fujioka ..... B41J 3/46 400/642
8,491,072 B2 * 7/2013 Yamagishi ..... B41J 2/155 347/14
9,283,779 B2 * 3/2016 Hobo ..... B41J 11/0085
2002/0041068 A1 * 4/2002 Madsen ..... B41J 11/0025 271/183
2007/0127090 A1 * 6/2007 Nonaka ..... H04N 1/0057 358/498
2010/0084803 A1 * 4/2010 Akihiro ..... B41J 11/007 271/3.22
2012/0056925 A1 3/2012 Yamagishi et al.
2012/0236101 A1 * 9/2012 Kato ..... B41J 11/0085 347/104
2015/0360483 A1 * 12/2015 Nakamura ..... B41J 11/0085 347/104
2018/0207964 A1 * 7/2018 Hirashima ..... B41J 11/06
2018/0339529 A1 * 11/2018 Zirilli ..... B41J 11/007
2018/0345648 A1 * 12/2018 Swartz ..... B33Y 10/00
2018/0370256 A1 * 12/2018 Hirano ..... A61J 3/007

FOREIGN PATENT DOCUMENTS

JP 5479278 B2 * 4/2014 ..... B41J 2/155
JP 5642747 B2 * 12/2014 ..... B41J 11/0085

* cited by examiner

CONVEYANCE DEVICE AND PRINTER

CROSS-REFERENCE TO RELATED PATENT APPLICATIONS

This application claims priority to and the benefit of Japanese Patent Application No. 2017-008206, filed Jan. 20, 2017, and Japanese Patent Application No. 2017-008207, filed Jan. 20, 2017, the entire disclosure of which is incorporated herein by reference.

FIELD

The present invention relates to a conveyance device and a printer.

BACKGROUND

Printers that have an inkjet head for ejecting ink onto a conveyed medium, and a vacuum platen having a platen surface on which the medium is placed, and numerous suction holes formed in the platen surface, are known from the literature.

Printers of this type having an adjustment mechanism for adjusting the position of the suction hole group that produces negative pressure across the width of the conveyance belt, the adjustment mechanism being configured with valves for opening and closing multiple diverter parts connected to the suction holes, are also known. See, for example, JP-A-2008-183825.

A printer with a top platen having numerous platen holes, and a bottom platen having multiple plate members that can slide in the sub-scanning direction to change the size of the holes through the top and bottom platens, is described in JP-A-2012-51331.

However, because the configurations of the related art require multiple diverter parts and valves, or multiple plate members that slide in the sub-scanning direction, the parts count increases and the configuration becomes complex.

SUMMARY

Some embodiments disclosed herein provide a simple configuration for changing the opened or closed state of multiple suction holes, and simplify assuring sufficient suction.

Accordingly, a conveyance device according to one embodiment includes: a platen surface on which a conveyed medium is placed; suction holes that open in the platen surface, the suction holes include a first suction hole and a second suction hole being disposed at an interval in a specific direction; a first communication path configured to communicate with the first suction hole; a second communication path configured to communicate with the second suction hole; a shutter drum configured to rotate on an axis of rotation extending in the specific direction, and by rotating selectively open and close the first and second communication paths; and a suction fan configured to produce negative pressure in the inside space of the shutter drum, and apply suction to the suction holes communicating with an open communication path of the first and second communication paths.

This configuration enables changing the opened or closed state of multiple suction holes, and assuring desirable suction, using a configuration that is simpler than configurations of the related art having multiple diverter parts and valves, and configurations of the related art having multiple plate members.

According to various embodiments, the specific direction is the transverse axis perpendicular to the conveyance direction of the medium.

This configuration can increase the suction area along the transverse axis.

According to various embodiments, the specific direction is the conveyance direction of the medium.

This configuration enables selectively changing the open and closed state of suction holes disposed with a gap therebetween in the conveyance direction of the medium.

According to various embodiments, the communication path has, between the platen surface and the shutter drum, a suction chamber that communicates with one of the suction holes, and a through-hole communicating the suction chamber with the shutter drum.

This configuration easily achieves a wide suction area between a shutter drum and suction holes disposed at an interval in a specific direction.

According to various embodiments, the shutter drum is a hollow cylinder centered on an axis of rotation extending in the specific direction, one end of the shutter drum is open, and air inside the shutter drum is expelled by the suction fan from the open end.

This configuration enables easily and compactly configuring the shutter drum and suction fan, and advantageously reduces suction resistance.

According to various embodiments, the shutter drum has, along the circumference of the shutter drum at positions corresponding to the first communication path, an open part that opens the first communication path, and a closed part that closes the through-hole; and a rib, extending along the circumference, between the open parts corresponding to the first and second communication paths.

This aspect of the invention enables using a simple configuration to change the opened and closed states of multiple communication paths, and easily provides a shutter drum with sufficient rigidity.

According to another embodiment, a printer having: an inkjet head configured to eject ink onto a conveyed medium; a vacuum platen having a platen surface on which a conveyed medium is placed; suction holes that open in the platen surface, the suction holes include a first suction hole and a second suction hole being disposed at an interval in a specific direction; a first communication path configured to communicate with the first suction hole; a second communication path configured to communicate with the second suction hole; a shutter drum configured to rotate on an axis of rotation extending in the specific direction, and by rotating selectively open and close the first communication path and second communication path; and a suction fan configured to produce negative pressure in the inside space of the shutter drum, and apply suction to the suction holes communicating with an open communication path of the first and second communication paths.

This configuration enables changing the opened or closed state of multiple suction holes, and assuring desirable suction, using a configuration that is simpler than configurations of the related art having multiple diverter parts and valves, and configurations of the related art having multiple plate members.

Other objects and attainments together with a fuller understanding of the invention will become apparent and appreciated by referring to the following description and claims taken in conjunction with the accompanying drawings.

DESCRIPTION OF EMBODIMENTS

Various embodiments are described below with reference to the accompanying figures.

Figure 1:
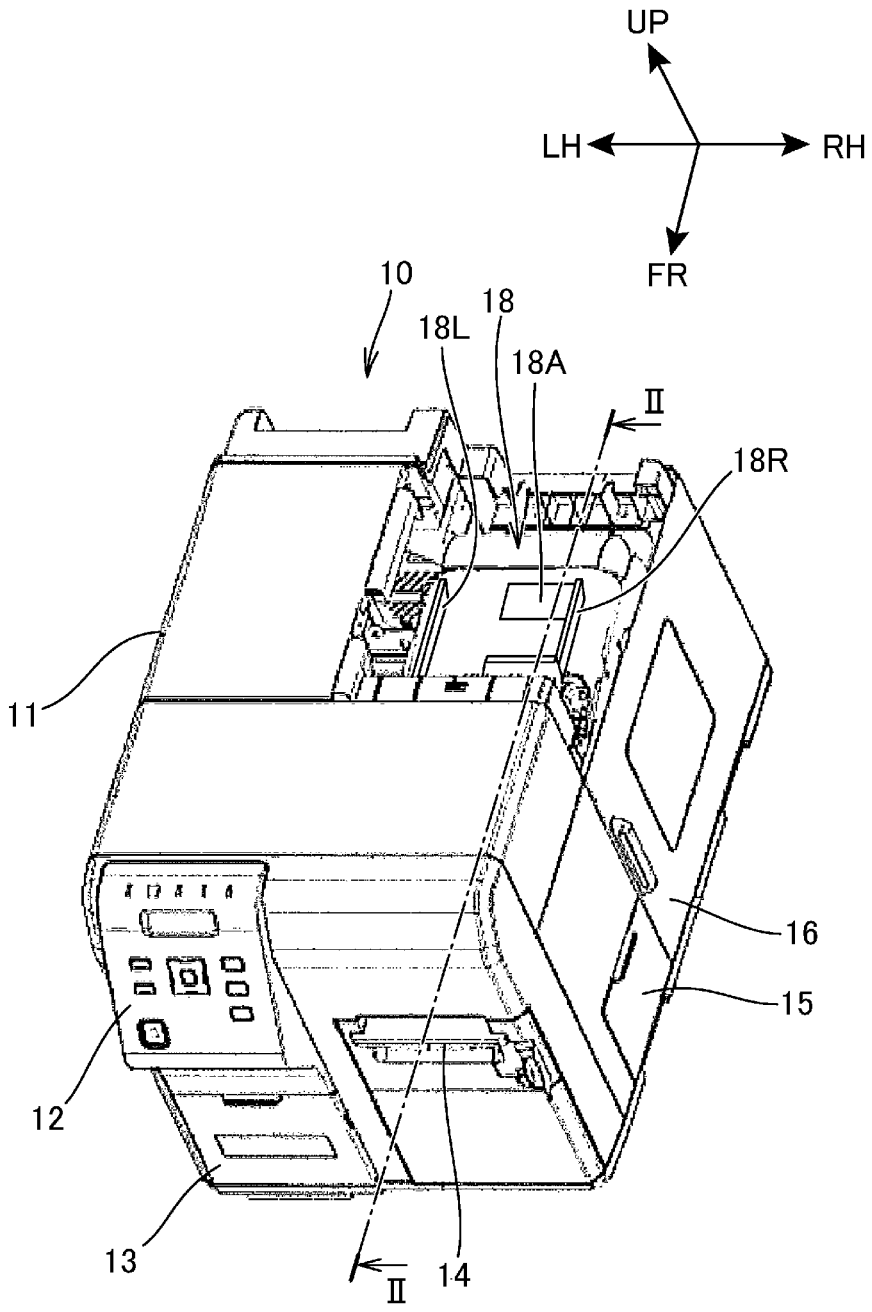
FIG. 1 is a perspective view of a printer according to a preferred embodiment of the invention.

FIG. 1 is a perspective view of a printer 10 according to a first embodiment of the invention.

The printer 10 in this example is a label printer that prints on continuous paper S (recording medium, medium) such as label paper having labels affixed at a regular interval to a continuous liner (backer). This printer 10 connects by wire or wirelessly through a USB (Universal Serial Bus) cable or LAN (local area network) to an information processing device, and prints based on print data sent from the information processing device.

In FIG. 1 and other figures, FR indicates the front of the printer 10, LH indicates the left side of the printer 10, RH indicates the right side of the printer 10, and UP indicates the top of the printer 10.

As shown in FIG. 1, the printer 10 has a basically rectangular case 11 embodying the housing of the printer 10. An operating panel 12 with operating buttons is provided on the front FR of the case 11. Below the operating panel 12 is a pull-out type ink cartridge loading opening 13. A slotted paper exit (media exit) 14 from which the continuous paper S is discharged after printing is formed in the front FR on the right RH side of the operating panel 12.

A waste ink tank replacement opening 15 is disposed in the right RH side of the case 11 at the bottom toward the front FR, and a roll paper loading opening 16 is disposed toward the back from the waste ink tank replacement opening 15. An access cover not shown is disposed to the top of the case 11, and opening the access cover exposes a guide unit 18 disposed to the conveyance path 21 (described below) of the continuous paper S.

Figure 2:
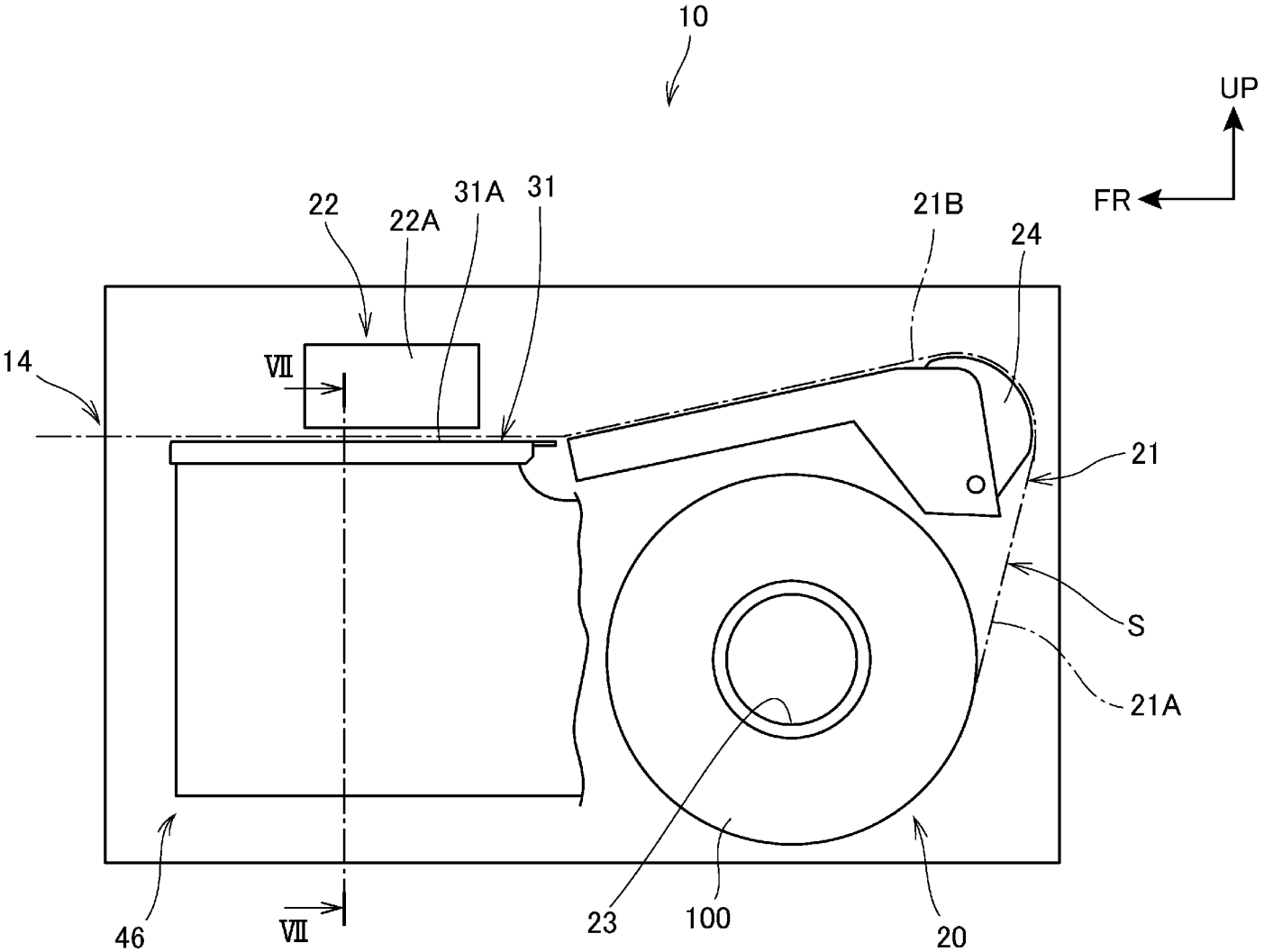
FIG. 2 is a section view through II-II in FIG. 1.

FIG. 2 is a schematic section view of the printer 10 through II-II in FIG. 1.

The printer 10 has a roll paper compartment 20 that holds a paper roll 100 of continuous paper S wound into a roll; a conveyance path 21 from the roll paper compartment 20 to the paper exit 14 in the case 11; and a printing mechanism 22 that prints on the continuous paper S at a specific position on the conveyance path 21. The continuous paper S is not limited to label paper, and various types of paper may be used. For example, fanfold paper folded at perforations formed at a regular interval in the conveyance direction of the paper may be used.

The roll paper compartment 20 (media loading unit) is located inside the case 11 at the bottom in the back, that is, the opposite side as the front FR. The conveyance path 21 includes a first path 21A extending toward the top UP from the roll paper compartment 20, and a second path 21B extending from the top end of the first path 21A toward the front FR.

A conveyance mechanism comprising multiple rollers and a motor that drives the rollers is disposed to the second path 21B. The conveyance mechanism conveys the continuous paper S from the upstream side to the paper exit 14 downstream. The printer 10 can also convey the continuous paper S in reverse by changing the direction of motor rotation.

The paper roll loaded in the roll paper compartment 20 is turned by a roll paper spindle 23. The conveyance path 21 also has a tension lever 24 that applies constant tension to the continuous paper. The tension lever 24 reduces the occurrence of slack on the conveyance path 21.

Disposed to the second path 21B are a guide unit 18, and a platen unit 46 including a vacuum platen 31. The vacuum platen 31 is located on front FR side of the guide unit 18 on the second path 21B.

The guide unit 18 functions as a paper guide for the continuous paper S. The guide unit 18 includes a flat feed plate 18A (FIG. 1) located vertically below the conveyed continuous paper S; and guide walls 18L, 18R rising from the feed plate 18A from the opposite sides on the width X (also referred to as the width direction or the transverse axis), which is perpendicular to the conveyance direction of the continuous paper S. Guide wall 18L is on the left LH side (one side) of the feed plate 18A, and guide wall 18R is located on the right RH side (other side) of the feed plate 18A.

The guide walls 18L, 18R extend in the conveyance direction of the continuous paper S, contact the sides (side edges) of the continuous paper S, which are the edges on the transverse axis X perpendicular to the conveyance direction, and guide the position of the side edges.

Guide wall 18L is part of a fixed guide, which remains in a stationary position. The other guide wall 18R is part of a movable guide that can move relative to the stationary guide. This configuration enables the user of the printer 10 to easily load continuous paper of different widths by setting one edge of the continuous paper against the guide wall on the stationary side, and then adjusting the position of the other guide to the other edge of the paper when adjusting the position of the movable guide to the width of the continuous paper S. In this configuration, the edge of the continuous paper S that contacts the stationary guide wall 18L is always conveyed at the same position on the transverse axis X perpendicularly to the conveyance direction regardless of the width of the continuous paper S. As a result, skewing of the continuous paper S is prevented by the guide walls 18L, 18R.

A guide is disposed on both sides of the transverse axis X in this embodiment, but a configuration having a guide on only one side is also conceivable. In this case, the continuous paper S is conveyed with one side edge in contact with the one guide.

The printing mechanism 22 has an inkjet head 22A (fluid ejection head) that ejects ink onto the conveyed continuous paper S. By ejecting ink from the ink cartridge, the inkjet head 22A forms dots on the continuous paper S, and prints images by combinations of dots. The inkjet head 22A is disposed to a position opposite the vacuum platen 31 with the second path 21B therebetween. In this embodiment, the inkjet head 22A is vertically above the vacuum platen 31. As a result, the inkjet head 22A ejects ink to the continuous paper S passing between the inkjet head 22A and the vacuum platen 31.

The printer 10 according to this embodiment is a line printer with the inkjet head 22A having a nozzle row spanning the entire width of the continuous paper S.

The vacuum platen 31 has a platen surface 31A, and the continuous paper S placed on the platen surface 31A is pulled by suction to the platen surface 31A by a suction unit as described below. By conveying the continuous paper S while operating the vacuum platen 31, that is, while suctioning the continuous paper S, the printer 10 can convey the continuous paper S while reducing uplift of the continuous paper S from the platen surface 31A. As a result, a desired platen gap can be maintained between the continuous paper S and the inkjet head 22A. The configuration of the vacuum platen 31 is particularly effective when conveying continuous paper S that is wound in a roll because the continuous paper S can easily separate from the platen surface 31A due to curl in the continuous paper S.

Figure 3:
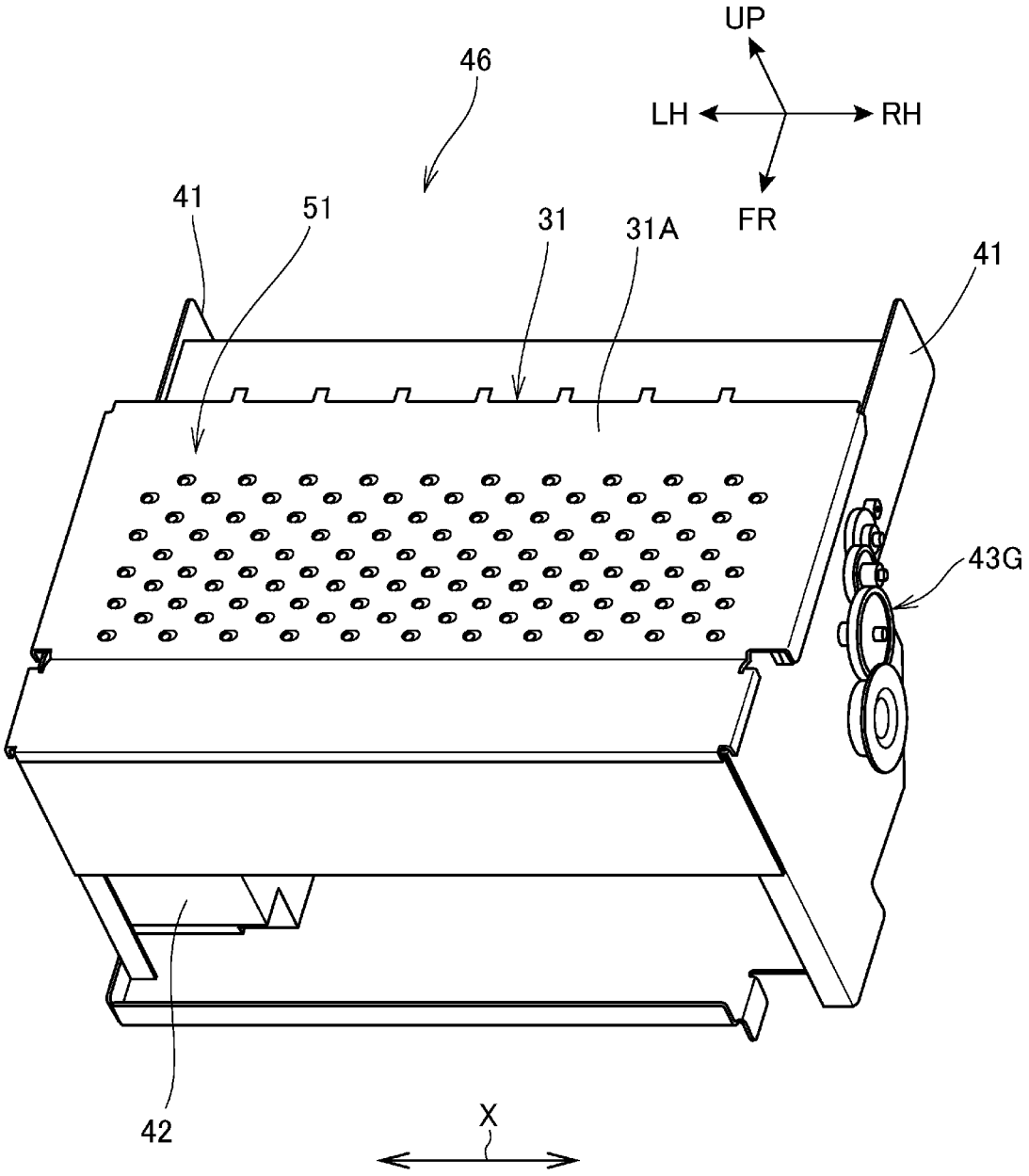
FIG. 3 is a perspective view of the platen unit.
Figure 4:
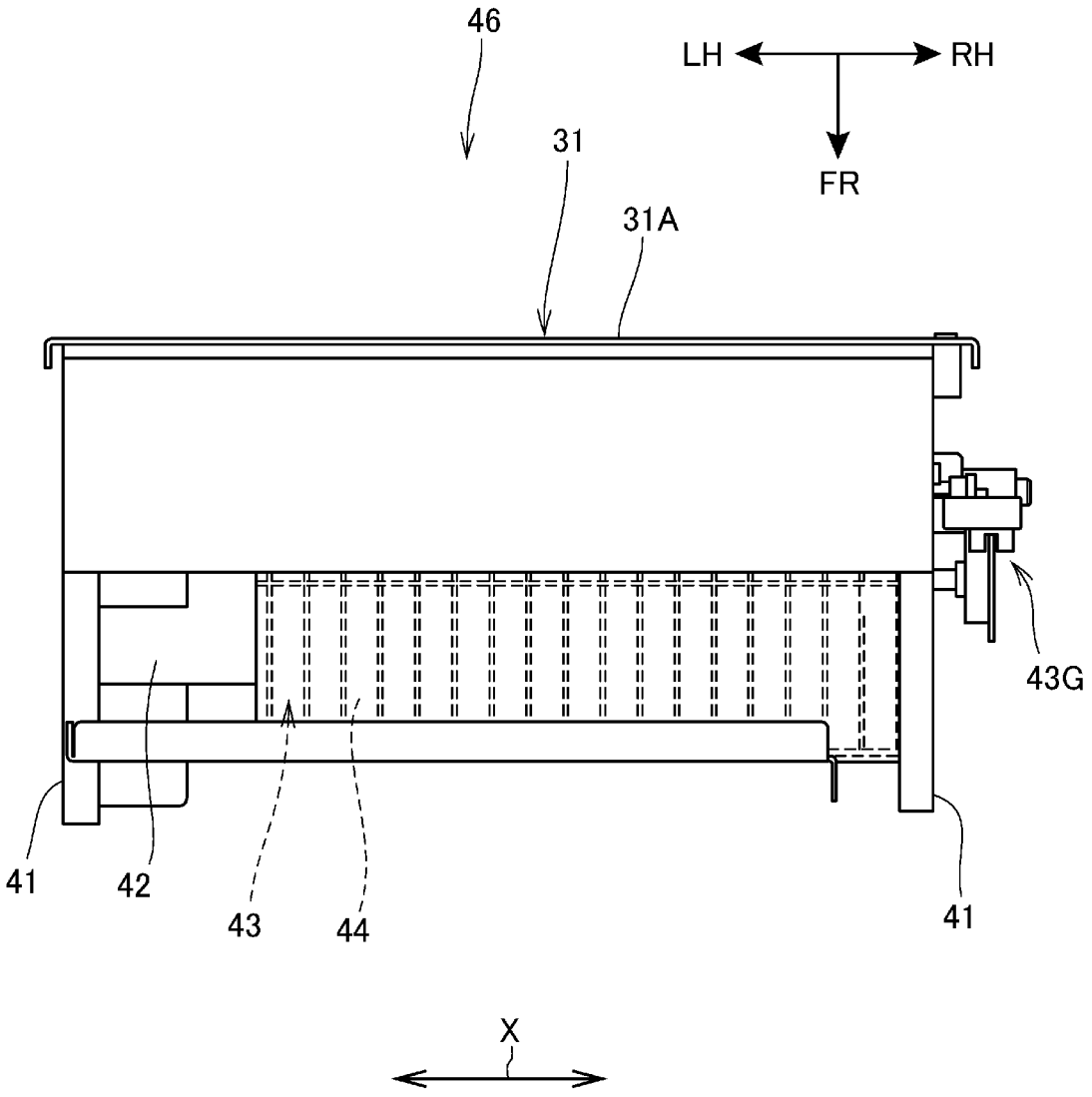
FIG. 4 is a view of the platen unit from the front.

FIG. 3 is an oblique view of the platen unit 46, and FIG. 4 is an outside view of the platen unit 46 from the front FR.

The platen unit 46 includes a vacuum platen 31, support frame 41, suction fan 42, shutter drum unit 43, and drum cover 44 (shutter cover). The vacuum platen 31 is a flat platen that extends on the transverse axis X, that is, perpendicularly to the conveyance direction of the second path 21B. The vacuum platen 31 is supported by a pair of support frames 41 with a gap therebetween on the transverse axis X.

The suction fan 42, shutter drum 43A of the shutter drum unit 43, and drum cover 44 are disposed between the pair of support frames 41 on the opposite side of the vacuum platen 31 as the inkjet head 22A (vertically below the vacuum platen 31). As described below, the suction fan 42 functions as a suction unit that produces suction in the vacuum platen 31.

Figure 5:
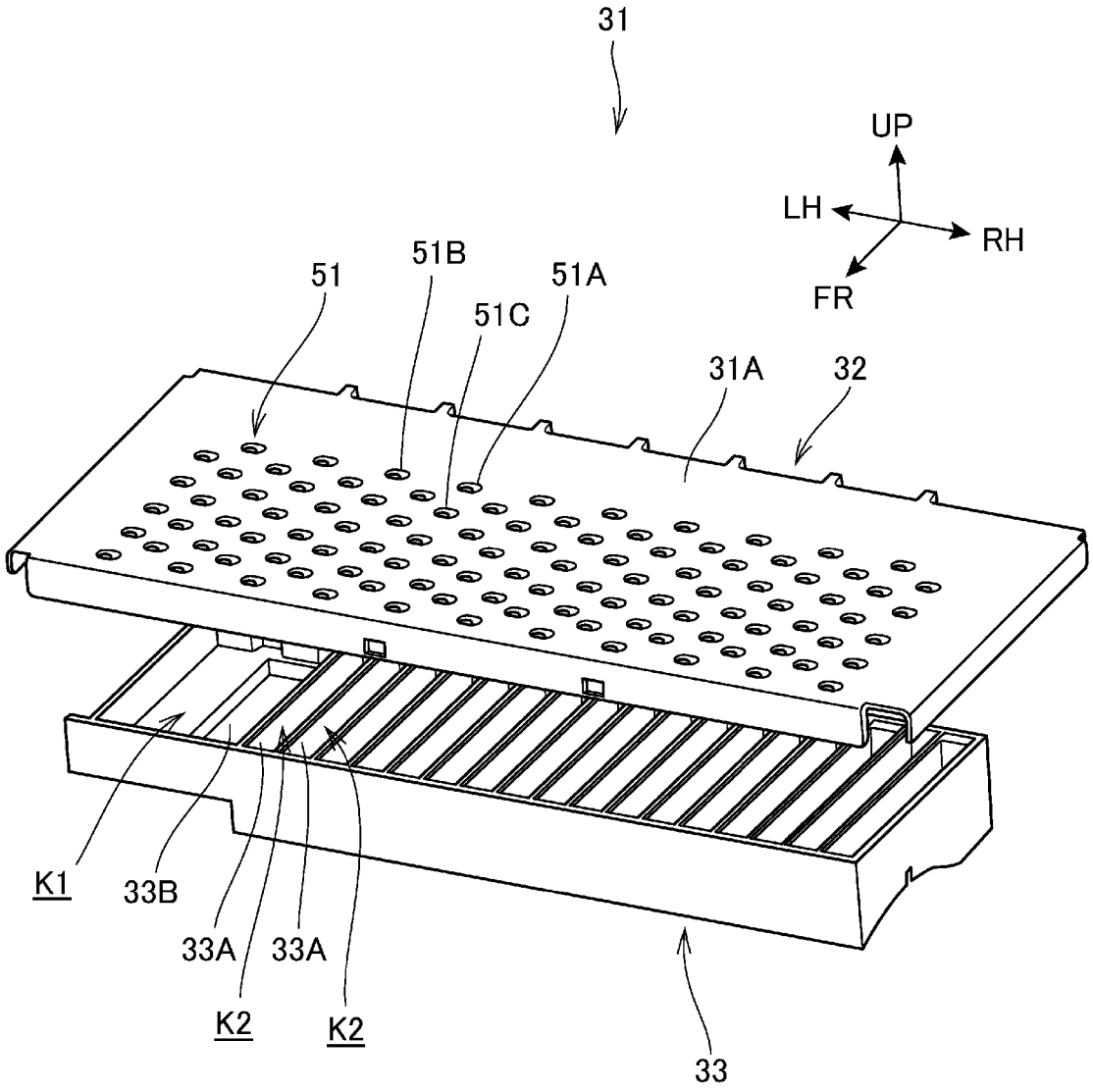
FIG. 5 is an exploded perspective view of the vacuum platen.

FIG. 5 is an exploded oblique view of the vacuum platen 31.

The vacuum platen 31 includes a platen 32 with a platen surface 31A on which the continuous paper S is placed, and a box 33 of which the open side is covered by the platen 32. The platen 32 extends on the transverse axis X perpendicularly to the conveyance direction of the continuous paper S.

The platen 32 has numerous suction holes 51 opened in the platen surface 31A. The suction holes 51 of the platen 32 include a group of first suction holes 51A, and a group of second suction holes 51B offset from the first suction holes 51A with a gap therebetween on the transverse axis X. In this embodiment, the first suction holes 51A are positioned on the right RH side of the second suction holes 51B. The platen 32 also has third suction holes 51C at the same position on the transverse axis X as the first suction holes 51A, but with a gap therebetween in the conveyance direction of the continuous paper S. As described further below, each of the first suction holes 51A, second suction holes 51B, and third suction holes 51C communicate with one of multiple suction chambers K2.

Figure 6:
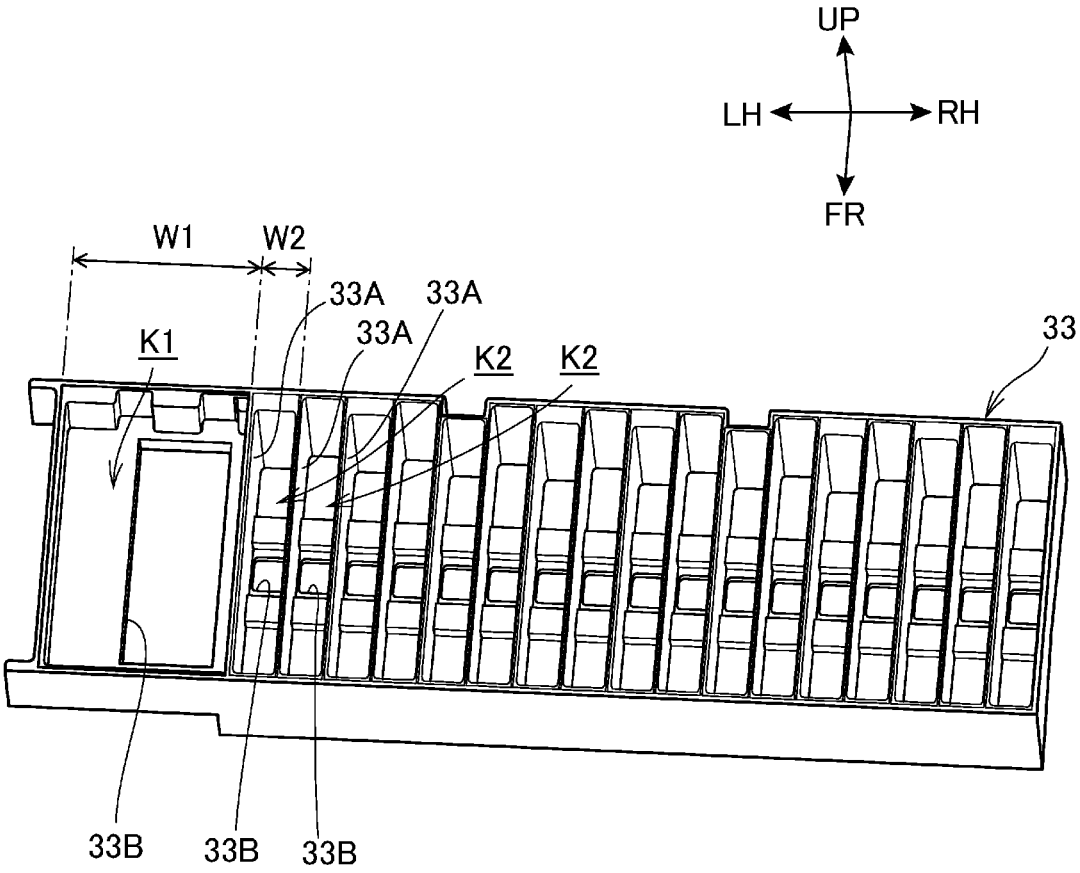
FIG. 6 is a perspective view of the vacuum platen box.

FIG. 6 is an oblique view of the box 33.

As shown in FIG. 5 and FIG. 6, the box 33 has multiple dividers 33A disposed with a gap therebetween across the width X of the continuous paper S and dividing the space between the bottom of the box 33 and the platen 32 into multiple chambers. Through-holes 33B communicating with the space divided by the dividers 33A are formed in the bottom of the box 33.

In this configuration, air in the spaces formed by the dividers 33A is suctioned by the suction fan 42 through the through-holes 33B. As a result, the spaces divided by the dividers 33A function as suction chambers, that is, negative pressure chambers in which the pressure is lower than atmospheric pressure. The suction fan 42 produces negative pressure in the suction holes 51 communicating with the suction chambers, and produces suction on the continuous paper S.

As shown in FIG. 6, the suction chambers of the box 33 include suction chamber K1, and multiple suction chambers K2 between suction chamber K1 and the end of the box 33.

Of the guide units 18 disposed on the opposite sides of the width X of the continuous paper S, suction chamber K1 is located on the side of the stationary guide (left LH side) in this embodiment of the invention. As described above, the edge of the conveyed continuous paper S that contacts the guide wall 18L part of the stationary guide is conveyed at the same widthwise X position regardless of the width of the continuous paper S. As a result, even if continuous paper S of a different width is loaded, the continuous paper S passes over the area of the platen 32 where suction chamber K1 is located.

In this embodiment of the invention, suction chamber K1 is shaped according to the area of the narrowest usable continuous paper S. Suction chamber K1 communicates with the suction holes 51 located in this area, and width W1 (FIG. 6), which is the length of the suction chamber K1 on the transverse axis X, corresponds to the width X of the area that may be occupied by the narrowest continuous paper S. As a result, suction chamber K1 functions as a chamber producing negative pressure in the suction holes 51 disposed to the area of the narrowest continuous paper S.

In this embodiment the suction chamber K1 also extends in the conveyance direction of the continuous paper S, and communicates with the multiple suction holes 51 formed within the width X of the suction chamber K1. As a result, negative pressure can be produced through the suction chamber K1 in all suction holes 51 in the area through which the narrowest continuous paper S is conveyed.

Width W2 (FIG. 6), which is the length of the suction chambers K2 on the transverse axis X, corresponds to the gap between adjacent suction holes 51 in the width X direction. More specifically in this embodiment of the invention, width W2 matches the gap between adjacent suction holes 51. The multiple suction chambers K2 function as chambers producing negative pressure in specific units of suction holes 51 that do not communicate with the first suction chamber K1.

In this embodiment, suction chambers K2 are also shaped extending in the conveyance direction of the continuous paper S, and communicate with the multiple suction holes 51 formed within the width X of the corresponding suction chamber K2. In other words, first suction holes 51A and third suction holes 51C communicate with the same suction chamber K2. As a result, negative pressure is produced in each of the suction holes 51 communicating with a particular suction chamber K2 at the same position on the transverse axis X.

In this embodiment of the invention width W2 matches the gap between adjacent suction holes 51 and negative pressure is produced in each suction hole 51 at the same position on the transverse axis X, but the relationship between width W2 and the gap between suction holes 51 is not so limited. For example, if width W2 is equal to twice the widthwise X gap between suction holes 51, the area where the suction holes that go to negative pressure through a single suction chambers K2 is twice that of this embodiment, and the configuration of the box 33, and control related to changing the suctioned area, are simplified.

As shown in FIG. 6, the through-holes 33B in suction chamber K1 are larger than the through-holes 33B in the suction chambers K2. As a result, air from suction chamber K1 communicating with multiple suction holes 51 can be suctioned more quickly than from suction chambers K2, and negative pressure can be easily produced in the many suction holes 51 communicating with suction chamber K1.

The through-holes 33B of the suction chambers K2 are disposed in the center of the conveyance direction of the suction chambers K2. This facilitates producing appropriate negative pressure in multiple suction holes 51 arrayed in the conveyance direction.

Figure 7:
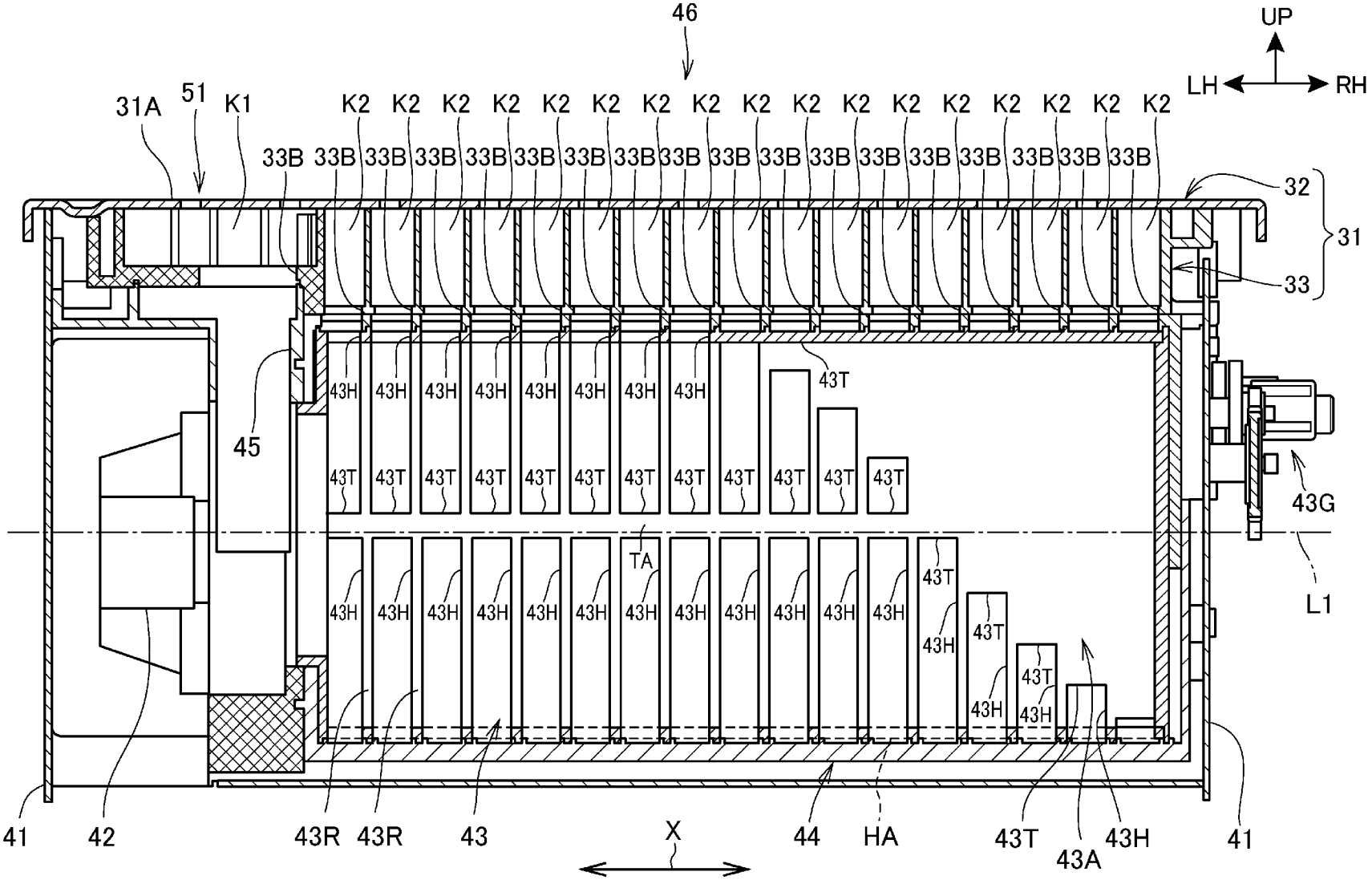
FIG. 7 is a section view of the platen unit in FIG. 2 through VII-VII.

FIG. 7 is a section view of the platen unit 46 through VII-VII in FIG. 2.

The shutter drum unit 43 has a shutter drum 43A disposed vertically below the vacuum platen 31 and between the pair of support frames 41. The shutter drum 43A is supported by the pair of support frames 41 freely rotatably on an axis of rotation L1 extending perpendicularly to the conveyance direction of the continuous paper S. The shutter drum 43A is a hollow cylinder centered on the axis of rotation L1 and extending across the width X of the vacuum platen 31. One end of the shutter drum 43A (the end on the stationary side of the guide unit 18 in this embodiment) is open. The suction fan 42 is adjacent to the open end.

The shutter drum 43A also has openings 43H. When the openings 43H are set to positions corresponding to the through-holes 33B in the suction chambers K2, the inside of the shutter drum 43A and the suction chambers K2 communicate through the through-holes 33B. The shutter drum 43A also has closed parts 43T. When the closed parts 43T are set to positions corresponding to the through-holes 33B in the suction chambers K2, the opening of the through-holes 33B on the shutter drum 43A side are closed by the closed parts 43T.

The openings 43H and closed parts 43T are formed along the circumference of the shutter drum 43A. As a result, when the shutter drum 43A turns on the axis of rotation L1 to a specific rotational position, the openings 43H or closed parts 43T are set to positions corresponding to specific through-holes 33B. Therefore, by rotating the shutter drum 43A, specific through-holes 33B communicate with the inside of the shutter drum 43A, or the openings to specific through-holes 33B on the shutter drum 43A side are closed.

Along the circumference of the shutter drum 43A at positions corresponding to the through-holes 33B in the suction chambers K2, the shutter drum 43A has openings 43H for opening the through-holes 33B, and closed parts 43T for closing the through-holes 33B.

As shown in FIG. 7, the closed parts 43T include fully-closed parts TA extending in the same direction as the axis of rotation L1 and spanning both ends of the shutter drum 43A. When the fully-closed parts TA are set to positions opposite the through-holes 33B by turning the shutter drum 43A, all through-holes 33B communicating with the suction chambers K2 are closed. Furthermore, because the fully-closed parts TA cross the width X of the shutter drum 43A, the fully-closed parts TA also function as frame members or reinforcing members of the shutter drum 43A.

The openings 43H include a fully-open part HA extending in the same direction as the axis of rotation L1 where the positions corresponding to each of the through-holes 33B in the suction chambers K2 are fully open (FIG. 7). As a result, when the fully-open part HA is set to a position opposite the through-holes 33B by turning the shutter drum 43A, all through-holes 33B communicating with the suction chambers K2 communicate with the inside of the shutter drum 43A.

The shutter drum 43A can rotate to a first angular position where all through-holes 33B communicating with the suction chambers K2 are open, and a second angular position where at least one of the through-holes 33B is closed (such as the position shown in FIG. 7).

The shutter drum 43A has curved ribs 43R extending circumferentially. The ribs 43R divide the width X of the openings 43H. Because the ribs 43R extend around the full circumference of the shutter drum 43A, the ribs 43R also function as reinforcing members (reinforcing ribs) that reinforce the shutter drum 43A.

The shutter drum unit 43 also has an axle (not shown) protruding from the shutter drum 43A along the axis of rotation L1, and a power transfer mechanism that transfers power to the axle. The power transfer mechanism includes a drive shaft (not shown) driven by power from a drive motor (not shown), and a speed reducer 43G that transfers power between the axle and drive shaft. Power from the drive motor (not shown) is transferred to the shutter drum 43A, which is driven rotationally. In this embodiment, the axle and the drive shaft are supported by the support frame 41 on the right RH side as shown in FIG. 3. The speed reducer 43G is disposed on the opposite side of the right RH support frame 41 as the shutter drum 43A.

The rotational position (angular position) of the shutter drum 43A is adjusted in this printer 10 by a control unit not shown controlling rotation (angular displacement) of the drive motor. For example, the control unit can detect by a sensor not shown, or acquire from a driver setting, information related to the width of the continuous paper S, and control the rotational position of the shutter drum 43A according to the width.

FIG. 7 shows the shutter drum 43A rotated to a position where the through-holes 33B of the suction chambers K2 to the eighth suction chamber K2 from the suction chamber K1 side communicate with the inside of the shutter drum 43A, and the through-holes 33B of the remaining suction chambers K2 are closed by the closed parts 43T.

As shown in FIG. 7, the shutter drum 43A in this embodiment is formed so that the starting position of the closed parts 43T shifts to the right RH side of the axis of rotation L1 each time the shutter drum 43A turns a specific angle of rotation.

Therefore, when the shutter drum 43A turns in a first direction of the circumference of the shutter drum 43A, the number of consecutive through-holes 33B that are open from the suction chamber K1 side (left LH side) increases with rotation of the shutter drum 43A; and when the shutter drum 43A turns in a second direction, which is opposite the first direction, the number of consecutive through-holes 33B that are open from the suction chamber K1 side (left LH side) decreases with rotation of the shutter drum 43A.

Figure 8:
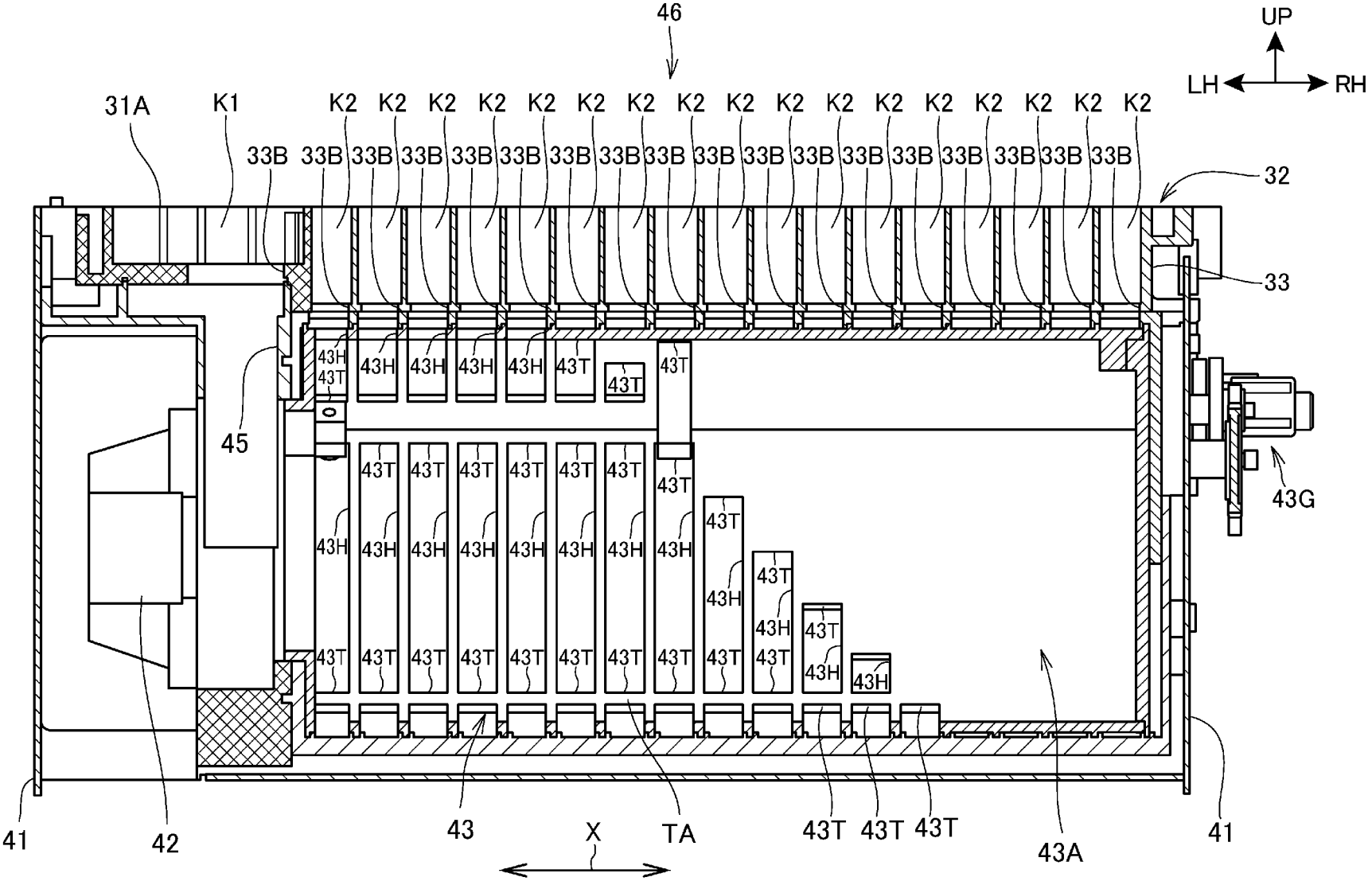
FIG. 8 is a vertical section view of the platen unit when the shutter drum is rotated to a different rotational position than shown in FIG. 7.

FIG. 8 is a vertical section view of the platen unit 46 when the shutter drum 43A turns to a rotational position different from that shown in FIG. 7. In FIG. 8, the shutter drum 43A has turned in the second direction from the position shown in FIG. 7, and the number of consecutive suction chambers K2 in which the through-holes 33B are open from the suction chamber K1 side changes from 8 to 5.

In other words, the open or closed state of the paths that communicate with the first suction holes 51A (suction chambers K2 and through-holes 33B), and the paths that communicate with the suction holes 51B formed a specific distance from the first suction holes 51A on the transverse axis X, can be selectively changed by rotating the shutter drum 43A.

Therefore, by adjusting the rotational position of the shutter drum 43A according to the width of the continuous paper S, the printer 10 in this embodiment of the invention can open only those suction holes 51 that communicate with the suction chambers K2 in the area corresponding to the width of the continuous paper S to communicate with the inside of the shutter drum 43A.

As shown in FIG. 7 and FIG. 8, the through-holes 33B communicating with suction chamber K1 communicate with a suction channel 45 disposed between the suction fan 42 and shutter drum 43A. This suction channel 45 goes to negative pressure by the suction fan 42 suctioning air from inside this suction channel 45. As a result, when the suction fan 42 is driven, negative pressure is always produced in the suction holes 51 communicating with suction chamber K1, and suction is applied to the continuous paper S.

Configurations omitting the suction channel 45 are also conceivable. In this case, the shutter drum 43A extends to vertically below the suction chamber K1, and may be configured with openings 43H that always open the through-holes 33B in the suction chamber K1.

The drum cover 44 is a cover that covers at least part of the shutter drum 43A, and has openings in the areas corresponding to the through-holes 33B formed in the bottom of the vacuum platen 31.

As a result of this drum cover 44, the inside of the shutter drum 43A is a space that is closed off from the surrounding and does not communicate with the outside of the drum cover 44. The through-holes 33B communicate with the inside of the shutter drum 43A through the openings in areas corresponding to the through-holes 33B.

The suction fan 42 is disposed between the shutter drum 43A and the support frame 41 on the suction chamber K1 side of the suction chambers K2, and vertically below the vacuum platen 31. The suction fan 42 vents to the outside air from inside the suction channel 45 communicating with the suction chamber K1 and the inside of the shutter drum 43A. In other words, the suction fan 42 functions as a suction unit that suctions air from the suction channel 45 and inside the shutter drum 43A, and produces negative pressure in the suction holes 51.

In this configuration, one end of the shutter drum 43A (the left side in this embodiment) is open, and the suction fan 42 vents air from inside the shutter drum 43A from this end. Therefore, compared with a configuration segmenting the communication path, air from inside the shutter drum 43A can be expelled more efficiently along the axis of rotation L1 of the shutter drum 43A.

In addition, because the suction fan 42 is adjacent to the shutter drum 43A on the axis of rotation L1, the suction fan 42 can be compactly configured. The air path between the shutter drum 43A and suction fan 42 can also be shortened, and air resistance can be decreased. Negative pressure can therefore be efficiently produced inside the shutter drum 43A by the suction fan 42, and operating noise can be reduced.

While a suction fan 42 is used as the suction unit producing negative pressure in the suction holes in this embodiment, a vacuum pump or other mechanism may be used instead of a suction fan 42.

As described above, this embodiment of the invention has a shutter drum 43A that turns on an axis of rotation L1 extending on the transverse axis X, and a suction fan 42 for producing negative pressure inside the shutter drum 43A. The shutter drum 43A functions as a shutter that rotates to selectively change the open/closed state of the first communication path communicating with the first suction holes 51A, and the second communication path that communicates with the second suction holes 51B. The suction fan 42 functions as a suction unit that produces suction in the suction holes communicating with the open communication paths.

This configuration reduces the number of parts compared with configurations of the related art having multiple diverter part and valves, and configurations of the related art having multiple plate members. This configuration efficiently reduces air (suction) resistance because the suction fan 42 pulls air from inside the shutter drum 43A and produces negative pressure inside the shutter drum 43A. The open or closed state of multiple suction holes 51 can be therefore be easily changed, and suction can be more easily assured. Furthermore, because the suction holes 51 are disposed with gaps therebetween on the transverse axis X, the suction area can be increased along the transverse axis X.

The shutter drum 43A is also hollow, and extends with the axis of rotation L1 centered on the transverse axis X. In this configuration, one end of the shutter drum 43A (the left side in this embodiment) is open, and the suction fan 42 vents air from inside the shutter drum 43A from this end. Air from inside the shutter drum 43A can therefore be expelled more efficiently along the axis of rotation L1 of the shutter drum 43A than with a configuration that divides the communication path into segments. The shutter drum 43A and suction fan 42 can also be compactly arranged, and air (suction) resistance can be reduced.

The shutter drum 43A also has, along the circumference of the shutter drum 43A at positions corresponding to the first and second communication paths, openings 43H for opening the communication paths, and closed parts 43T for closing the communication paths. In addition, ribs 43R extending circumferentially are disposed between the openings 43H corresponding to the first and second communication paths. This configuration enables easily changing the open or closed state of the communication paths, while also providing a shutter drum 43A with sufficient rigidity.

This embodiment describes applying the invention to a vacuum platen 31 (platen unit 46) used in a printer 10, but the invention is not so limited. For example, the invention may be applied to the conveyance device of a non-inkjet printer. The invention is also not limited to use in printers, and may be applied to conveyance devices for conveying a conveyed product (medium) other than continuous paper S.

Structure of Communication Path Between Shutter Drum 43A and Vacuum Platen 31

The communication path between the shutter drum 43A and vacuum platen 31 is described next.

Figure 9:
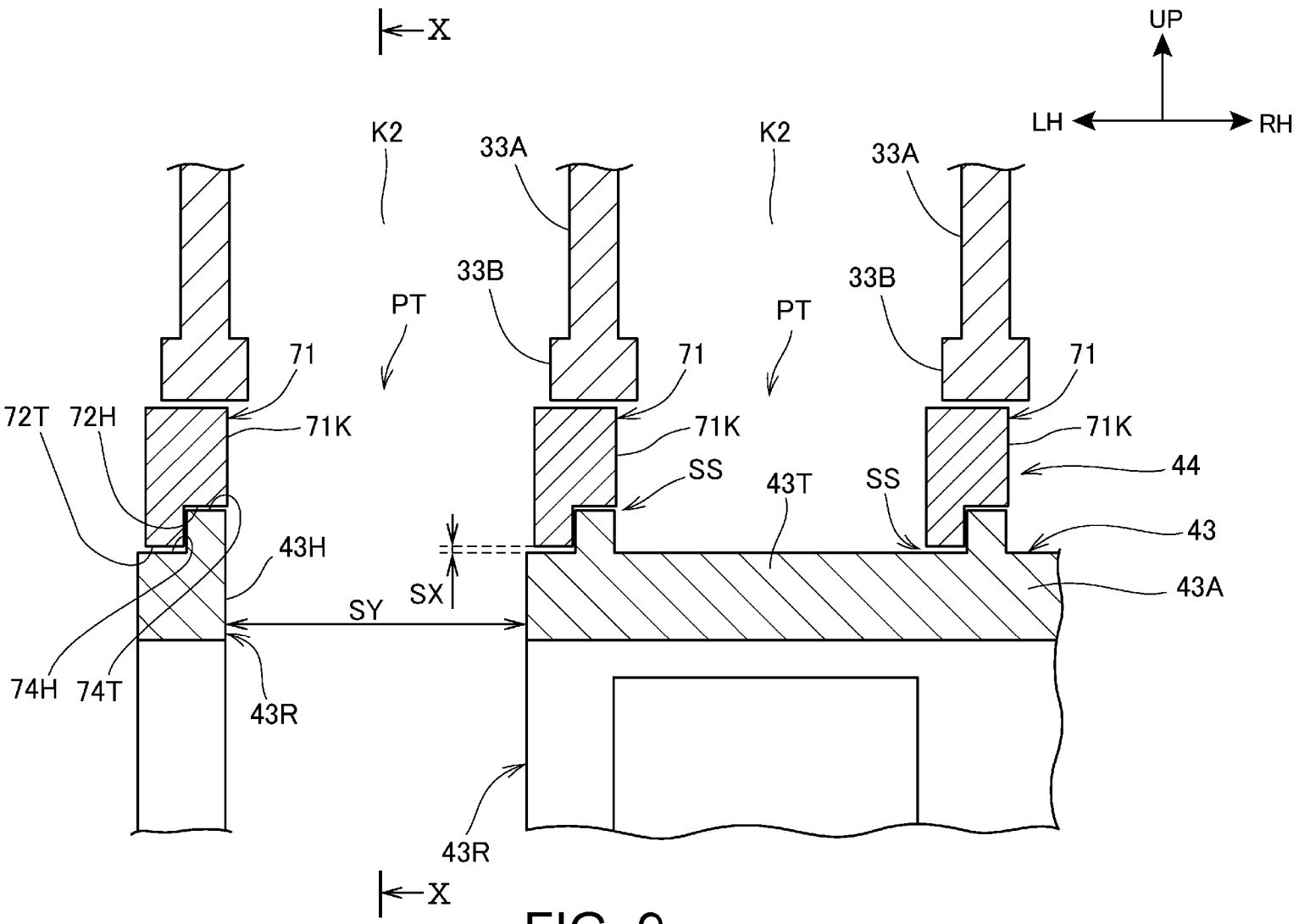
FIG. 9 illustrates the structure of passages between the shutter drum and vacuum platen.
Figure 10:
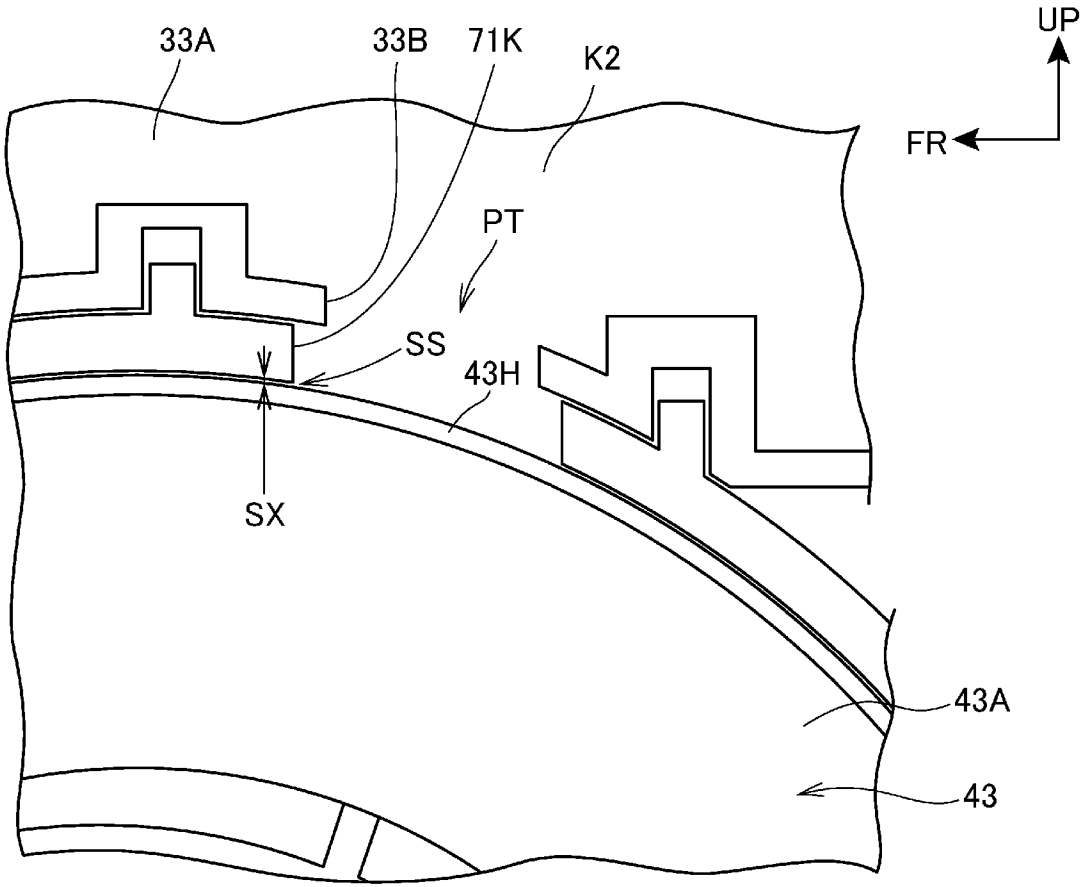
FIG. 10 is a section view through X-X in FIG. 9.

FIG. 9 is an enlarged view of part of FIG. 7 showing the structure of the communication path between the shutter drum 43A and vacuum platen 31. In FIG. 7, the through-holes 33B of the suction chambers K2 to the eighth suction chamber K2 from the suction chamber K1 (left LH) side communicate with the inside of the shutter drum 43A. FIG. 9 shows the eight and ninth suction chambers K2 from the left LH side. FIG. 10 is a section view through X-X in FIG. 9.

As shown in FIG. 9, the drum cover 44 is a member including a surface on the shutter drum 43A side of the vacuum platen 31. Multiple dividers 71 separate the communication paths (reference numeral PT) to the suction chambers K2.

Openings 71K, which are the spaces separated by the dividers 71 on the transverse axis X between the dividers 71, communicate with the through-holes 33B in the bottom of the vacuum platen 31 and the shutter drum 43A. As a result, the suction chambers K2 communicate independently with the inside of the shutter drum 43A. As shown in FIG. 10, the length of the openings 71K along the circumference of the shutter drum 43A is greater than the length of the through-holes 33B. The length of the openings 71K along the circumference of the shutter drum 43A may be equal to the length of the through-holes 33B. The shape of the openings 71K may be any shape enabling communication with the through-holes 33B, and the openings 71K may be round, oval, or polygonal.

FIG. 9 shows two openings 71K adjacent on the transverse axis X when the opening 71K on the left LH side communicates through an opening 43H with the inside of the shutter drum 43A, and the opening 71K on the right RH side is closed by the closed part 43T.

In this example, the shutter drum 43A is separated from the dividers 71. As a result, the shutter drum 43A turns without contacting the dividers 71. This reduces the load produced by friction with members on the vacuum platen 31 side when the shutter drum 43A turns, and the shutter drum 43A therefore turns smoothly.

Adjacent communication paths PT communicate through the gaps SS formed between the shutter drum 43A and the dividers 71 separated from the shutter drum 43A (see FIG. 9). Even if the communication path PT on one side (the left LH side in the example in FIG. 9) is open and the communication path PT on the other side (the right RH side in this example) is closed, air may be suctioned through the communication path PT on the other (right RH) side by negative pressure produced in the communication path PT on the one side (the left LH side) if this gap SS is large. If air is suctioned through the other communication path PT, negative pressure may be produced in the other communication path PT even if it is closed, and suction through the suction holes 51 communicating with the one communication path PT may be reduced.

As shown in FIG. 9, the shutter drum 43A and dividers 71 are therefore configured in this embodiment so that the cross-sectional area SX of the gap SS when seen in vertical section along the communication path PT is smaller than the open area SY of the communication path PT.

More specifically, cross-sectional area SX is the cross-sectional area of the gap SS when seen in section perpendicular to the center axis (left-right in FIG. 9) of the gap SS. If the cross-sectional area SX of the gap SS increases to the same area as the open area SY of the communication path PT, path resistance decreases and air or ink flow more easily through the gaps SS between adjacent communication paths PT.

However, because the cross-sectional area SX of the gap SS in this embodiment is smaller than the open area SY, resistance increases in the path from the communication path PT through the gap SS, and inflow of air to the gap SS is limited. Negative pressure being created in the other communication path PT even though the other communication path PT is closed (that is, the opening 71K is closed by closed part 43T) is suppressed, and suction in the suction holes 51 communicating through the one communication path PT can be efficiently maintained. Furthermore, because the possibility of ink or other foreign matter suctioned through the one communication path PT flowing into the gap SS is reduced, ink or other foreign matter adhering to the inside of the gap SS is also suppressed.

As shown in FIG. 9, the dividers 71 have a protruding part 72T (protrusion) projecting toward the shutter drum 43A from the vacuum platen 31, and a recessed part 72H receding from the shutter drum 43A in the direction away from the distal end of the protruding part 72T.

The protruding part 72T is an annular rib extending along the circumference of the shutter drum 43A.

As described above, the shutter drum 43A has curved ribs 43R extending circumferentially between openings 43H adjacent on the transverse axis X.

The shape of the ribs 43R corresponds to the protruding part 72T and recessed part 72H on the platen side. That is, the rib 43R has a protruding part 74T at a position on the transverse axis X not coincident to the protruding part 72T of the divider 71, with the protruding part 74T opposing recessed part 72H. The ribs 43R also have a recessed part 74H not coincident on the transverse axis X to the recessed part 72H, with the recessed part 74H opposing protruding part 72T.

The protruding part 74T is also an annular rib extending along the circumference of the shutter drum 43A.

The protruding part 72T of the divider 71 and the protruding part 74T of the shutter makes the gap SS between the vacuum platen 31 and the shutter drum 43A bend between adjacent communication paths PT. As a result, path resistance is greater than in a configuration in which the gap SS is a straight line between adjacent communication paths PT. Movement of air between adjacent communication paths PT is therefore suppressed.

As described above, in the communication paths PT through which the suction holes 51 communicate with the inside of the shutter drum 43A (suction space), this embodiment of the invention has a shutter drum 43A that is located between the suction holes 51 and the suction space, and moves without touching the vacuum platen 31. A suction fan 42 (suction unit) produces negative pressure in the suction space of the shutter drum 43A, and produces suction in the suction holes 51 that communicate with the communication paths PT.

When the shutter drum 43A turns, this configuration reduces the friction load produced by contact with members on the vacuum platen 31 side (dividers 71). In a configuration in which the shutter drum 43A rotates in contact with members (dividers 71) on the vacuum platen 31 side, minute ink droplets or foreign matter may penetrate the gap SS between the shutter drum 43A and dividers 71, and the ink droplets or foreign matter may increase the tribological load between the shutter drum 43A and dividers 71. Because the shutter drum 43A is separated from the dividers 71 in this configuration, the chance of the tribological load increasing due to penetration of minute ink droplets or foreign matter to the gap SS between the shutter drum 43A and dividers 71 is reduced.

In this configuration, the structure of the air paths between the shutter drum 43A and vacuum platen 31 separates the shutter drum 43A from the dividers 71 between adjacent communication paths PT. In addition, the cross-sectional area SX of the gaps SS between the shutter drum 43A and dividers 71 when seen in section along the communication paths PT is less than the open area SY of the paths.

As a result, movement of ink droplets or foreign matter between adjacent communication paths PT can be suppressed. Therefore, air and ink move smoothly through the communication paths PT, suction can be efficiently increased, and in the event ink is suctioned into the gap SS, ink remaining in the gap SS can be suppressed and adverse effects on the opening and closing of the communication paths PT (equivalent to opening and closing of the suction holes 51) can be suppressed.

This embodiment of the invention also has a drum cover 44 that is disposed between the shutter drum 43A and vacuum platen 31, and functions as a shutter cover covering at least part of the shutter drum 43A. A protruding part 72T projecting toward the shutter drum 43A is disposed to the surface of the drum cover 44 on the shutter drum 43A side, and the gap SS is the gap between the protruding part 72T and shutter drum 43A. This configuration reduces the chance of air or ink flowing through the gap SS between the shutter drum 43A and the protruding part 72T on the platen side.

This embodiment also has, on the shutter drum 43A side of the drum cover 44, a recessed part 72H receding from the protruding part 72T to the opposite side as the shutter drum 43A; and the shutter drum 43A has a rib 43R with a protruding part 74T that fits into the recessed part 72H. In this configuration the gap SS works as a bent path, and the chance of ink or air moving through the gap SS is reduced.

This embodiment describes a configuration in which the drum cover 44 has dividers 71 separating the communication paths through which air travels through the suction holes 51 to the suction space inside the shutter drum 43A, but the invention is not so limited. For example, the dividers 71 could be disposed in unison with the dividers 33A of the vacuum platen 31, and the dividers 71 omitted from the drum cover 44.

In other words, a configuration in which protruding parts 72T extending toward the shutter drum 43A are disposed to the shutter drum 43A side surface of the vacuum platen 31, and the gaps SS are gaps between the protruding parts 72T and shutter drum 43A, is also conceivable. This configuration reduces the chance of air or ink flowing through the gap SS between the protruding part 72T and shutter drum 43A. As a result, even if ink is suctioned into the suction holes 51, adversely affecting opening and closing the suction holes 51 can be suppressed.

A preferred embodiment of the invention is described above, but the invention is not so limited and can be modified and adapted in many ways without departing from the scope of the accompanying claims.

For example, the direction in which the suction holes 51 are formed with a gap therebetween and the direction of the axis of rotation L1 of the shutter drum 43A are aligned with the transverse axis X in the embodiment described above, but the invention is not so limited and they may be aligned in a specific direction other than on the transverse axis X.

For example, the axis of rotation L1 of the shutter drum 43A may be aligned with the conveyance direction of the continuous paper S, the medium, that is, to the front FR. In this case, the open or closed state of the suction holes 51 formed with a gap therebetween in the conveyance direction of the continuous paper S (front FR) can be selectively changed by the shutter drum 43A. When the continuous paper S moves in the conveyance direction, for example, this configuration can open the suction holes 51 and apply suction only in the area covered by the continuous paper S in the conveyance direction in conjunction with movement of the continuous paper S.

The foregoing embodiment describes a configuration using a shutter drum 43A in which the cross-sectional area SX of the gap SS is less than the open area SY of the air path, but is not limited to a shutter drum 43A. The chance of ink or air moving between adjacent communication paths PT is also reduced in a configuration in which the shutter moves without touching the vacuum platen 31, and the cross-sectional area SX of the gap SS is less than the open area SY of the air path.

Figure 11:
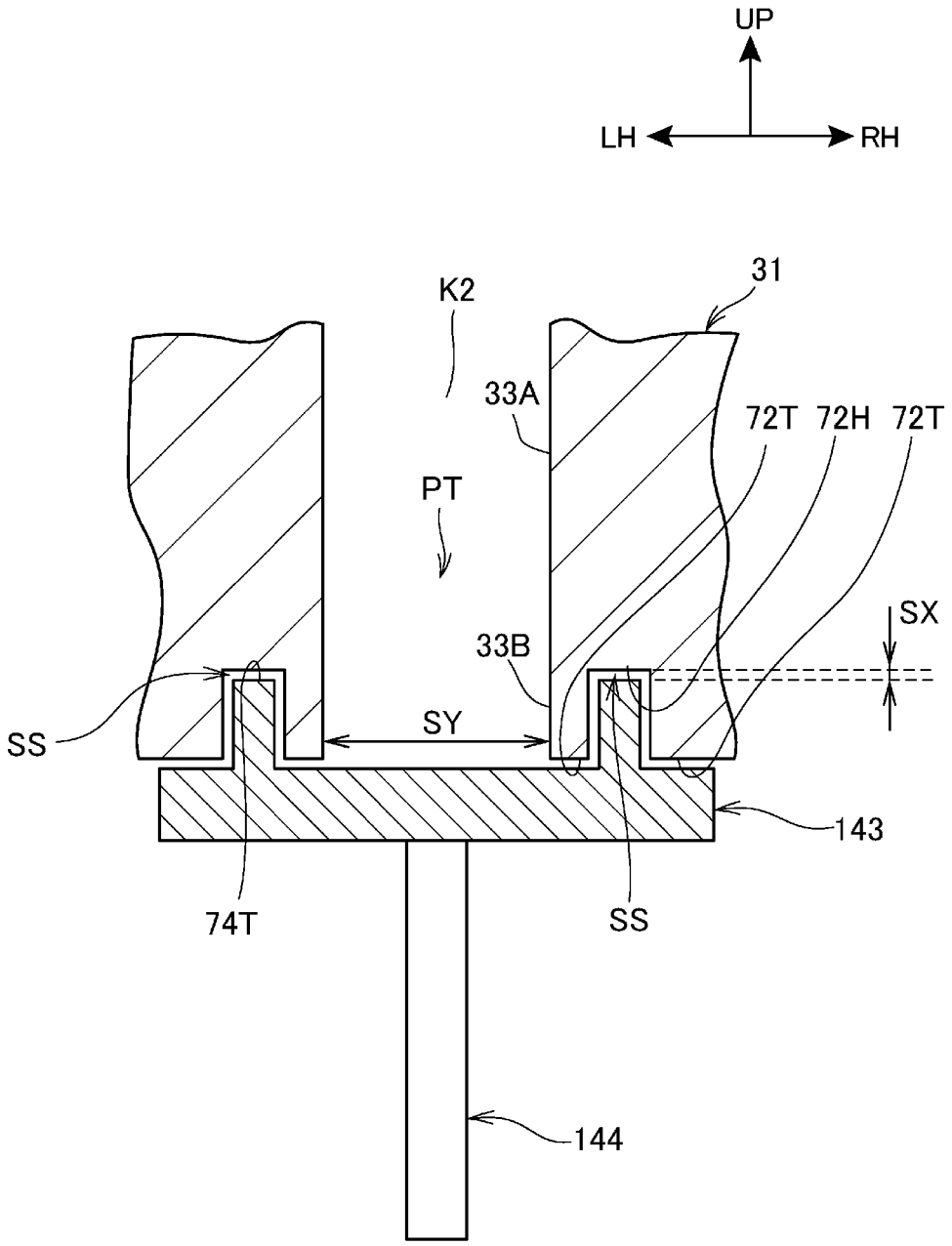
FIG. 11 shows an example of a configuration using a valving element instead of a shutter drum.

FIG. 11 shows an example of a configuration using a valving element 143 instead of a shutter drum 43A. Note that like parts in this embodiment and the embodiment described above are identified by the same reference numerals in FIG. 11.

In FIG. 11, the valving element 143 is a member that moves vertically to and away from the through-hole 33B of the communication path PT, and is moved by means of a cam mechanism 144 to an up position (closed position) closing the through-hole 33B, or to a down position (open position) opening the through-hole 33B. FIG. 11 shows the valving element 143 in the closed position. The valving element 143 functions as a shutter that moves between the up position and down position without contacting the vacuum platen 31. The valving element 143 has annular protruding parts 74T that protrude toward the dividers 71 separating adjacent communication paths PT.

The divider 71 has protruding parts 72T projecting toward the valving element 143, and recessed parts 72H recessed away from the valving element 143 from the end of the protruding part 72T. Protruding part 72T is an annular rib extending circumferentially to the valving element 143, and recessed part 72H is an annular channel extending circumferentially to the valving element 143. The valving element 143 has a protruding part 74T that fits into the recessed part 72H of the dividers 71. The protruding part 74T is an annular rib extending circumferentially to the valving element 143.

As shown in FIG. 11, when seen in vertical section along the communication path PT, the cross-sectional area SX of the gap SS between the protruding part 74T of the valving element 143 and the recessed part 72H of the vacuum platen 31 is less than the open area SY of the communication path PT. Flow resistance from the communication path PT to the gap SS is therefore high, the flow of air into the gap SS is limited, and adhesion of ink or foreign matter in the gap SS is reduced.

The protruding part 72T of the dividers 71 and the protruding part 74T of the valving element 143 make the gap SS between the vacuum platen 31 and valving element 143 bend between adjacent communication paths PT. As a result, path resistance is greater than in a configuration in which the gap SS is a straight line between adjacent communication paths PT. Movement of air between adjacent communication paths PT is therefore suppressed.

The foregoing embodiments are described with reference to a line printer, but the invention can also be applied to serial printers having an inkjet head 22A disposed movably in a main scanning direction (corresponding to the transverse axis X) perpendicular to the conveyance direction.

The structure and shape of the vacuum platen 31, shutter drum 43A, and drum cover 44 in the foregoing embodiments can also be changed as desired. For example, the platen surface 31A may be a curved vacuum platen.

The shape of the openings of the suction holes 51 in the foregoing embodiments is also not limited to round or oval, and any desired shape, including polygonal shapes, can be used.

The foregoing embodiments also describe applying the invention to a printer 10 that prints to continuous paper S, but the invention is not so limited, and the invention can be applied to various types of printers, including cut-sheet (slip) printers.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A conveyance device comprising:

a platen surface configured to receive a medium;

suction holes that open in the platen surface, the suction holes include a first suction hole and a second suction hole being disposed at an interval in a specific direction;

a first communication path configured to communicate with the first suction hole;

a second communication path configured to communicate with the second suction hole;

a hollow cylindrical shutter drum configured to rotate around an axis of rotation extending in the specific direction, and by rotating selectively, open and close the first and second communication paths; and a suction fan configured to produce negative pressure in an inside space of the shutter drum, and apply suction to the suction holes communicating with an open communication path of the first and second communication paths.

2. The conveyance device described in claim 1, wherein:

the specific direction is a transverse axis perpendicular to a conveyance direction of the medium.

3. The conveyance device described in claim 1, wherein:

the specific direction is a conveyance direction of the medium.

4. The conveyance device described in claim 1, wherein:

the first communication path and the second communication path each have, between the platen surface and the shutter drum, a suction chamber that communicates with one of the suction holes, and a through-hole communicating the suction chamber with the shutter drum.

5. The conveyance device described in claim 1, wherein:

the shutter drum is centered on the axis of rotation extending in the specific direction, one end of the shutter drum is an open end, and air inside the shutter drum is expelled by the suction fan from the open end of the shutter drum.

6. The conveyance device described in claim 1, wherein:

the shutter drum has, along a circumference of the shutter drum at positions corresponding to the first communication path, a first open part that opens the first communication path, and a closed part that closes the first communication path; and a rib, extending along the circumference, between the first open part corresponding to the first communication path and a second open part corresponding to the second communication path.

7. A printer comprising:

an inkjet head configured to eject ink onto a conveyed medium;

a vacuum platen having a platen surface configured to receive medium;

suction holes that open in the platen surface, the suction holes include a first suction hole and a second suction hole being disposed at an interval in a specific direction;

a first communication path configured to communicate with the first suction hole;

a second communication path configured to communicate with the second suction hole;

a hollow cylindrical shutter drum configured to rotate around an axis of rotation extending in the specific direction, and by rotating selectively, open and close the first communication path and the second communication path; and a suction fan configured to produce negative pressure in an inside space of the shutter drum, and apply suction to the suction holes communicating with an open communication path of the first and second communication paths.

8. The printer described in claim 7, wherein:

the first communication path and the second communication path are adjacent communication paths;

the shutter drum moves without contacting the vacuum platen;

the shutter drum is separated from dividers that separate the first communication path and the second communication path; and a cross-sectional area of a gap between the shutter drum and one of the dividers when seen in section along the first communication path is less than an open area of the communication path.

9. The printer described in claim 8, wherein:

a protrusion projecting to a shutter drum side is disposed to the shutter drum side of the vacuum platen, and the gap is between the protrusion and the shutter drum.

10. The printer described in claim 9, further comprising:

on a surface of the vacuum platen on the shutter drum side, a recess recessed toward a side away from the shutter drum; and the shutter drum having a rib that fits into the recess.

11. The printer described in claim 8, further comprising:

a shutter cover disposed between the shutter drum and the vacuum platen, and covering part of the shutter drum; and on a surface of the shutter cover on a shutter drum side, a protrusion projecting to the shutter drum side;

the gap is between the protrusion and the shutter drum.

12. The printer described in claim 11, further comprising:

in the surface of the shutter cover on the shutter drum side, a recess recessed toward a side away from the shutter drum;

the shutter drum having a rib that fits into the recess.

13. The printer described in claim 7, wherein:

the specific direction is a transverse axis perpendicular to a conveyance direction of the medium.

14. The printer described in claim 7, wherein:

the specific direction is a conveyance direction of the medium.

15. The printer described in claim 7, wherein:

the first communication path and the second communication path each have, between the platen surface and the shutter drum, a suction chamber that communicates with one of the suction holes, and a through-hole communicating the suction chamber with the shutter drum.

16. The printer described in claim 7, wherein:

the shutter drum is centered on the axis of rotation extending in the specific direction, one end of the shutter drum is an open end, and air inside the shutter drum is expelled by the suction fan from the open end of the shutter drum.

17. The printer described in claim 7, wherein:

the shutter drum has, along a circumference of the shutter drum at positions corresponding to the first communication path, a first open part that opens the first communication path, and a closed part that closes the first communication path; and a rib, extending along the circumference, between the first open part corresponding to the first communication path and a second open part corresponding to the second communication path.

18. The conveyance device of claim 1, wherein the shutter drum includes a first opening that is configured to align with the first communication path and extends around a first length of an outer circumference of the shutter drum and, wherein the shutter drum includes a second opening that is configured to align with the second communication path and extends around a second length of the outer circumference of the shutter drum, wherein the first length and the second length of the outer circumference are different.

19. The conveyance device of claim 1, further comprising at least one divider positioned between the shutter drum and the suction holes and separating the first communication path and the second communication path, wherein the shutter drum is separated from the at least one divider such that the shutter drum rotates without contacting the at least one divider.

* * * * *